US006702635B2

(12) United States Patent
Soares

(10) Patent No.: US 6,702,635 B2
(45) Date of Patent: Mar. 9, 2004

(54) INFLATABLE CHAIR

(75) Inventor: Dominique Soares, Dammarie les Lys (FR)

(73) Assignee: PSCV, Dammarie-les-Lys (FR)

( * ) Notice: Subject to any disclaimer, the term of this patent is extended or adjusted under 35 U.S.C. 154(b) by 0 days.

(21) Appl. No.: 10/158,138

(22) Filed: May 31, 2002

(65) Prior Publication Data

US 2002/0182951 A1 Dec. 5, 2002

(30) Foreign Application Priority Data

Jun. 1, 2001 (FR) ..... 01 07263

(51) Int. Cl.[7] ..... B63C 9/08
(52) U.S. Cl. ..... 441/131; 441/40
(58) Field of Search ..... 441/40, 66, 67, 441/129, 130, 131; 114/345, 346

(56) References Cited

U.S. PATENT DOCUMENTS 2,173,963 A * 9/1939 Eubank ..... 441/131
4,601,667 A 7/1986 Hull
4,687,452 A 8/1987 Hull
4,962,921 A * 10/1990 Simmons ..... 472/129
6,217,401 B1 4/2001 Peterson

FOREIGN PATENT DOCUMENTS

DE 93 04 319 8/1993
FR 2 116 846 7/1972

* cited by examiner

*Primary Examiner*—Stephen Avila
(74) *Attorney, Agent, or Firm*—Young & Thompson

(57) ABSTRACT

An inflatable chair including an annular body 2 forming a toroidal chamber 3 which has a top axial end 8 and a bottom axial end 9 and can be filled with air, two plane walls 10, 11 perpendicular to the axis of revolution 4 of the annular body 2, a central chamber 12 coaxial with the annular body 2 formed by an interior portion 6 of the annular body 2 and said two plane walls 10, 11 fixed to the interior portion 6 of the annular body 2, characterized in that the plane walls 10, 11 are at an axial distance from the top and bottom axial ends 8, 9 of the annular body 2 in order to leave free spaces 13, 14 in the vicinity of the top and bottom axial ends 8, 9 of the annular body 2.

20 Claims, 1 Drawing Sheet

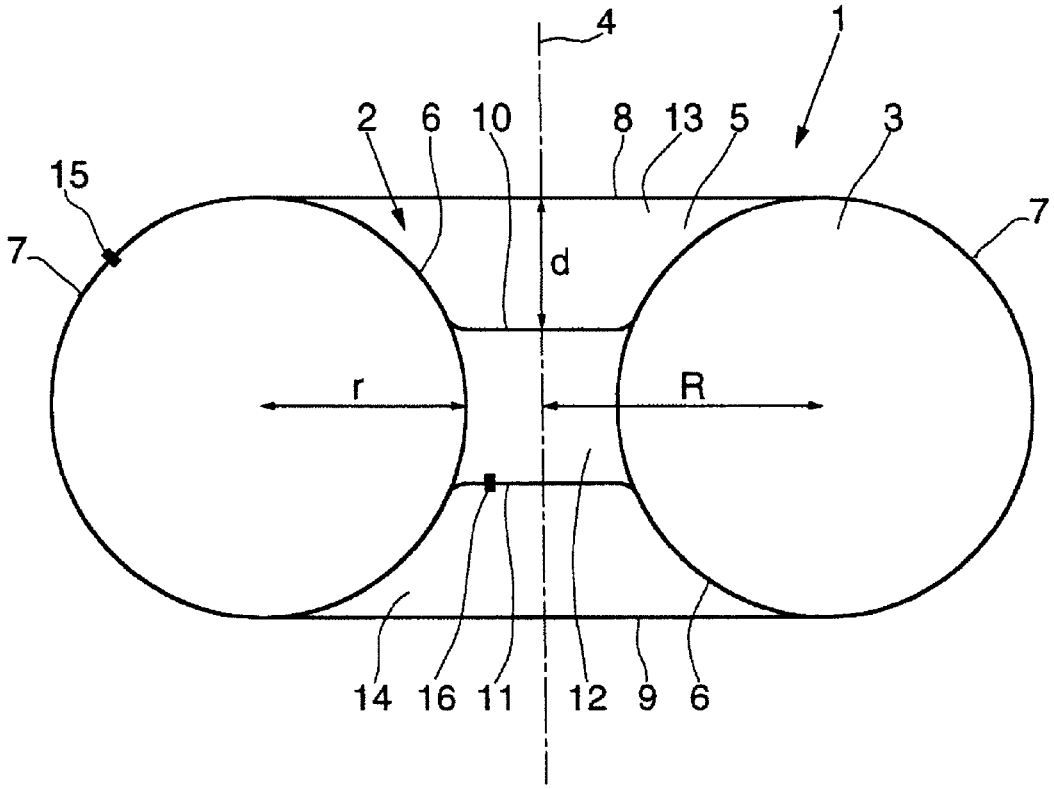
4
1
2
6
10
8
13
5
3
15
7
7
d
r
R
14
16
11
12
9
6

INFLATABLE CHAIR

BACKGROUND OF THE INVENTION

The present invention relates to an inflatable chair that can be used for resting or amusement.

DESCRIPTION OF THE RELATED ART

U.S. Pat. No. 4,687,452 discloses a floating inflatable chair intended to be used on water, including a seat portion fixed to a toroidal flotation chamber. A water ballast tank is formed by a top wall and a bottom wall that close off the bottom end of the flotation chamber and is intended to be filled with water to improve the stability of said inflatable chair.

It is therefore necessary to have a source of water nearby and to empty out the water contained in the inflatable chair after use. One wall of the ballast tank must include a water inlet valve.

SUMMARY OF THE INVENTION

The invention proposes an inflatable chair that is easy to use and can be inflated manually.

The invention also proposes an inflatable chair that is suitable for different uses and more stable, especially on a liquid surface.

The invention finally proposes a seat that can be produced at low cost.

The inflatable chair according to the invention includes an annular body, forming a toroidal chamber which has a top axial end and a bottom axial end and can be filled with air, two plane walls perpendicular to the axis of revolution of the annular body, a central chamber coaxial with the annular body formed by an interior portion of the annular body and said two plane walls fixed to the interior portion of the annular body, characterized in that the plane walls are at an axial distance from the top and bottom axial ends of the annular body in order to leave free spaces in the vicinity of the top and bottom axial ends of the annular body.

The plane walls are perpendicular to the axis of revolution and form a seat that makes the inflatable chair more comfortable to use. At the bottom, the space near the bottom axial end of the annular body improves the stability of the seat on any kind of surfacing, and more particularly on a liquid surface, in particular by reducing the pressure in this space, which presses the inflatable chair onto the ground or the liquid surface. The free space in the vicinity of the top axial end of the annular body, which has a hollow concave wall facing upward, provides a stable and comfortable seat for a user.

The plane walls are advantageously symmetrical with respect to an equatorial plane of the annular body. The inflatable chair is then symmetrical and can be used with a first plane wall or a second plane wall serving as the seat.

In one embodiment, the plane walls define with the interior portion of the annular body a central circular chamber which can be filled with air by means of a valve. Filling the central chamber with air makes the overall structure of the inflatable chair more rigid and the required level of comfort of the central seat of the inflatable chair can be adjusted.

The radius of the circular section of the toroidal chamber is preferably from 25% of the radius of the circle of revolution of the toroidal chamber to 85% of the radius of the circle of revolution of the toroidal chamber.

The axial distance between one axial end of the annular body and the adjacent plane wall is preferably from 25% of the radius of the circle of revolution of the toroidal chamber to 85% of the radius of the circle of revolution of the toroidal chamber. These proportions produce a comfortable seat and a stable seat at the same time as reducing the pressure inside the free space near the bottom axial end of the annular body sufficiently to improve the stability of the inflatable chair.

In one embodiment the walls are heat-welded to each other.

To be more precise, the free space between the plane wall and a top axial end of the annular body forms a stable and comfortable seat for a user. The free space between one plane wall and the bottom axial end of the annular body enables some of the air in the free space formed between the bottom plane wall and the bottom axial end of the annular body to be expelled by pressing on a top portion of the annular body or on the top plane wall. If the force exerted on the annular body or on the top plane wall is reduced, the pressure of the air in the toroidal chamber tends to return the inflatable chair to its initial shape, while the axial end of the annular body in contact with the plane surface forms a seal that prevents air penetrating from the outside toward said free space, so that the pressure inside said free space is reduced, which increases the stability of the inflatable chair on a hard surface or on a liquid surface.

BRIEF DESCRIPTION OF THE DRAWINGS

The present invention and its advantages will be better understood after studying the following detailed description of one embodiment, provided by way of non-limiting example and shown in the accompanying drawing, which is a view in section of an inflatable chair conforming to one aspect of the invention.

DESCRIPTION OF THE PREFERRED EMBODIMENTS

In the figure, an inflatable chair 1 includes an annular body 2 forming a toroidal chamber 3 with an axis of revolution 4 and a circular central space 5 coaxial with the annular body 2 and having an interior portion 6 oriented toward the circular space 5 and an exterior portion 7 oriented in the opposite direction. The interior portion 6 is at a distance from the axis 4 less than the radius R of the circle of revolution of the annular body 2. The exterior portion 7 of the annular body 2 is at a distance from the axis 4 greater than the radius R of the circle of revolution of the annular body 2. The circular section of the toroidal chamber 3 has a radius r.

The annular body 2 has a top axial end 8 and a bottom axial end 9. The circular central space 5 is closed axially by plane walls 10 and 11 perpendicular to the axis 4 and fixed to the interior portion 6 of the annular body 2 in a symmetrical fashion with respect to an equatorial plane of the annular body 2. A central chamber 12 coaxial with the annular body 2 is formed by the interior portion 6 of the annular body 2 and by said plane walls 10, 11 fixed to the interior portion 6 of the annular body 2. In the axial direction, the central chamber 12 is between the plane walls 10 and 11 and in the radial direction it is inside the interior wall 6 of the annular body 2.

The plane walls 10 and 11 are at an axial distance d from the top and bottom axial ends 8 and 9 of the annular body 2, leaving free spaces 13, 14 in the vicinity of the top and bottom axial ends 8, 9 of the axial body 2. The space 13 is defined by the plane wall 10 and the interior portion 6 of the annular body 2 axially between the plane wall 10 and the top axial end 8. The space 14 is defined by the plane wall 11 and the interior portion 6 of the annular body 2 axially between the plane wall 11 and the bottom axial end 9. A valve 15 on the plane wall 11 is used to fill the central chamber 12. A valve 16 on the exterior portion 7 of the annular body 2 is used to fill the toroidal chamber 3 with air.

In use, the inflatable chair 1 is disposed on a rigid plane surface or on a liquid surface. A person sitting on the inflatable chair applies pressure to the top axial end 8 of the annular body 2 and/or to the top plane wall 11. The annular body 2 is deformed, the volume of the toroidal chamber 3 decreases, and the pressure of the air contained in the toroidal chamber 3 creates a force capable of compensating the weight of the person sitting on the inflatable chair. When the person sits on the inflatable chair 1, the deformation of the annular body 2 reduces the volume of the free space 14 formed between the bottom plane wall 11 and the bottom axial end 9 of the annular body 2, and air in the free space 14 between the annular body 2 and the liquid or solid surface is expelled between the solid or liquid plane surface and the bottom axial end 9 of the annular body 2.

If the user moves in a way that reduces the force applied to the inflatable chair, and therefore reduces the pressure of the air contained in the toroidal chamber 3, the annular body 2 resumes its original shape due to the action of the pressure of the air enclosed in the toroidal chamber 3. Because the bottom axial end 9 of the annular body 2 is resting on a liquid or solid surface, the deformation of the portion of the annular body 2 in the vicinity of the bottom axial end 9 forms a seal between the liquid or solid surface and the bottom axial end 9 of the annular body 2. When the annular body 2 resumes its original shape the volume of the free space 14 increases. Because air cannot penetrate from the outside toward the free space 14, because of the seal formed between the annular body 2 and the solid or liquid surface, the pressure in the free space 14 is reduced, which presses the inflatable chair 1 onto the liquid or solid surface. The inflatable chair 1 is therefore stabilized by this reduction in pressure, which generates a supplementary force on the inflatable chair 1.

The radius r of the circular section of the toroidal chamber is preferably from 25% of the radius R of the circle of revolution of the toroidal chamber to 85% of the radius R of the circle of revolution of the toroidal chamber. These proportions produce a circular central space 5, within which the central chamber 12 and the free spaces 13 and 14 are formed, such that the reduced pressure in the free space 13 or 14 when the inflatable chair is used improves its stability.

The axial distance d between one axial end 8, 9 of the annular body 2 and the adjacent plane wall 10, 11 is preferably from 25% of the radius R of the circle of revolution of the toroidal chamber to 85% of the radius R of the circle of revolution of the toroidal chamber. The plane walls 10, 11 must be at an axial distance from the bottom and top axial ends 9, 8 of the annular body 2 to form a sufficient volume between the annular body 2 and a liquid or solid surface on which the annular body 2 rests.

The inflatable chair can be used with the top axial end 8 of the annular body 2 resting on a liquid or solid surface, i.e. with functions of the plane walls 10 and 11 and the top and bottom axial ends 8 and 9 of the annular body 2 reversed.

Filling the central chamber 12 with air improves the comfort of the user by giving them more support, because the deformation of the toroidal chamber 3 and the plane walls 10 and 11 when a user sits on the inflatable chair 1 increases the pressure of the air contained in the central chamber 12 and provides a force that supports the user of the seat. The pressure of the air enclosed in the central chamber 12 also prevents excessive deformation of the plane wall 10 or 11 on which the user is completely or partly seated, which would lead to a deformation of the annular chamber 3 that could compromise the reduction of the pressure in the free space 14.

The inflatable chair therefore offers a comfortable and stable seat for the user. It can have an outside diameter from 15 cm to 2.50 m and has various uses.

For example, inflatable chairs having an outside diameter of the order of 20 cm, which can be very easily transported and rapidly and easily inflated, can make it more comfortable to sit on a rigid surface such as a bench, for example.

Inflatable chairs can be manufactured in different sizes, to suit the size of the user. Thus inflatable chairs with small dimensions can be manufactured for children or adolescents.

The inflatable chair can advantageously be used for amusement, in particular for aquatic amusement. For example, the inflatable chair can be provided with fastening means such as eyelets.

An inflatable chair whose plane walls 10 and 11 are not symmetrical with respect to an equatorial plane of the annular body 2 can be envisaged.

The inflatable chair therefore provides a comfortable and stable seat. Depending on its dimensions, the inflatable chair can be portable, easily transported and inflated quickly and easily. Its particular structure produces an inflatable chair that is particularly stable, especially on a liquid surface.

What is claimed is:

1. An inflatable chair including an annular body (2), forming a toroidal chamber (3) which has a top axial end (8) and a bottom axial end (9) and can be filled with air, two plane walls (10, 11) perpendicular to the axis of revolution (4) of the annular body (2), a central chamber (12) coaxial with the annular body (2) formed by an interior portion (6) of the annular body (2) and said two plane walls (10, 11) fixed to the interior portion (6) of the annular body (2) and closing the central chamber, characterized in that the plane walls (10, 11) are at an equal axial distance from the top and bottom axial ends (8, 9) of the annular body (2) in order to leave free spaces (13, 14) in the vicinity of the top and bottom axial ends (8, 9) of the annular body (2), the central chamber forming a volume between the annular body and a surface on which the annular body rests.

2. A chair according to claim 1, characterized in that the plane walls (10, 11) are symmetrical with respect to an equatorial plane of the annular body (2).

3. A chair according to claim 1, characterized in that the plane walls (10, 11) define with the interior portion (6) of the annular body (2) a central chamber (12) that can be filled with air by means of a valve.

4. A chair according to claim 1, characterized in that the radius (r) of the circular section of the toroidal chamber (3) is from 25% of the radius (R) of the circle of revolution of the toroidal chamber (3) to 85% of the radius (R) of the circle of revolution of the toroidal chamber (3).

5. A chair according to claim 1, characterized in that the axial distance (d) between one axial end (8, 9) of the annular body (2) and the adjacent plane wall (10, 11) is from 25% of the radius (R) of the circle of revolution of the toroidal chamber (3) to 85% of the radius (R) of the circle of revolution of the toroidal chamber (3).

6. A chair according to claim 1, characterized in that the walls are heat-welded to each other.

7. A chair according to claim 2, characterized in that the plane walls (10, 11) define with the interior portion (6) of the annular body (2) a central chamber (12) that can be filled with air by means of a valve.

8. A chair according to claim 2, characterized in that the radius (r) of the circular section of the toroidal chamber (3) is from 25% of the radius (R) of the circle of revolution of the toroidal chamber (3) to 85% of the radius (R) of the circle of revolution of the toroidal chamber (3).

9. A chair according to claim 2, characterized in that the axial distance (d) between one axial end (8, 9) of the annular body (2) and the adjacent plane wall (10, 11) is from 25% of the radius (R) of the circle of revolution of the toroidal chamber (3) to 85% of the radius (R) of the circle of revolution of the toroidal chamber (3).

10. An inflatable chair, comprising:

an inflatable annular body (2) forming a toroidal chamber (3) about an axis of revolution (4) and surrounding a circular space (5), the annular body having a top axial end (8), a bottom axial end (9), an interior portion (6) oriented toward the circular space, and an exterior portion (7) oriented away from the circular space, the interior portion at a distance from the axis of revolution less than a radius of a circle of revolution of the annular body, the exterior portion at a distance from the axis of revolution greater than the radius of the circle of revolution; and an inflatable central chamber (12) closing the circular space, the central chamber comprising two plane walls with perimeters sealed to the interior portion, the two plane walls perpendicular to the axis of revolution, wherein the plane walls are at an equal axial distance from the top and bottom axial ends of the annular body leaving free spaces (13, 14) interior to planes defined by the top and bottom axial ends.

11. An inflatable chair, comprising:

an inflatable annular body (2) forming a toroidal chamber (3) about an axis of revolution (4) and surrounding a circular space (5), the annular body having a top axial end (8), a bottom axial end (9), an interior portion (6) oriented toward the circular space, and an exterior portion (7) oriented away from the circular space; and a central chamber (12) forming a volume closing the circular space, the central chamber comprising two circular plane walls with perimeters connected to the interior portion, the two plane walls perpendicular to the axis of revolution, wherein the plane walls are at an axial distance from the top and bottom axial ends of the annular body leaving free spaces (13, 14) interior to planes defined by the top and bottom axial ends.

12. The chair of claim 11, wherein, the interior portion is at a distance from the axis of revolution less than a radius of a circle of revolution of the annular body, and the exterior portion is at a distance from the axis of revolution greater than the radius of the circle of revolution.

13. The chair of claim 11, wherein, the annular body further comprises a first air valve;

the central chamber further comprises a second air valve; and each of the annular body and the central chamber are separately inflatable, segregated volumes.

14. The chair of claim 11, wherein, the central chamber further comprises a first air valve; and each of the annular body and the central chamber are inflatable volumes.

15. The chair of claim 14, wherein, the annular body further comprises a second air valve; and the annular body and the central chamber are separately inflatable volumes without air communications therebetween.

16. The chair of claim 10, wherein, the interior portion is at a distance from the axis of revolution less than a radius of a circle of revolution of the annular body, and the exterior portion is at a distance from the axis of revolution greater than the radius of the circle of revolution.

17. The chair of claim 10, wherein, the annular body further comprises a first air valve;

the central chamber further comprises a second air valve; and each of the annular body and the central chamber are separately inflatable, segregated volumes.

18. The chair of claim 10, wherein, the central chamber further comprises a first air valve; and each of the annular body and the central chamber are inflatable volumes.

19. The chair of claim 18, wherein, the annular body further comprises a second air valve; and the annular body and the central chamber are separately inflatable volumes without air communications therebetween.

20. The chair of claim 1, wherein, the annular body further comprises a first air valve;

the central chamber further comprises a second air valve;

each of the annular body and the central chamber are separately inflatable, segregated volumes; and the annular body and the central chamber are free of any air communication passages therebetween.

* * * * *